United States Patent [19]

Kawai et al.

[11] Patent Number: 4,981,748

[45] Date of Patent: Jan. 1, 1991

[54] HEAT TRANSFER RECORDING SHEET

[75] Inventors: Yutaka Kawai, Kurashiki; Yukio Tsuge, Ebina; Yukichi Murata, Sagamihara; Masahiro Yamamoto, Yokohama, all of Japan

[73] Assignee: Mitsubishi Kasei Corporation, Tokyo, Japan

[21] Appl. No.: 310,587

[22] Filed: Feb. 15, 1989

[30] Foreign Application Priority Data

Feb. 17, 1988 [JP] Japan ..... 63-34367

[51] Int. Cl.[5] ..... B41M 5/26

[52] U.S. Cl. ..... 428/216; 428/195; 428/323; 428/336; 428/337; 428/480; 428/484; 428/488.4; 428/500; 428/913; 428/914; 503/227

[58] Field of Search ..... 428/195, 500, 484, 488.1, 428/488.4, 913, 914, 213, 215, 216, 323, 336, 337, 480; 503/227

[56] References Cited

FOREIGN PATENT DOCUMENTS 0160098 6/1985 European Pat. Off. ..... 428/488.4
0194106 10/1986 European Pat. Off. ..... 428/488.4

OTHER PUBLICATIONS

Patent Abstracts of Japan, vol. 12, No. 67 (M-73) [2914], Mar. 2, 1988; & JP-A-62 212 192 (Mitsubishi Chem. Ind. Ltd.) 18-09-1987.

Patent Abstracts of Japan, vol. 10, No. 40 (M-454) [2097], Feb. 18, 1986; & JP-A-60 192 688 (Daiafoil K.K.) 01-10-1985.

Patent Abstracts of Japan, vol. 10, No. 134 (M-479) [2198], May 17, JP-A-60 259 495 (Canon K.K.) 12-2-1-1985.

Patent Abstracts of Japan, vol. 11, No. 221 (M-608) [2668], Jul. 17, 1987; & JP-A-62 37 192 (Carbon Paper K.K.) 02-18-1987.

*Primary Examiner*—Pamela R. Schwartz

*Attorney, Agent, or Firm*—Oblon, Spivak, McClelland, Maier & Neustadt

[57] ABSTRACT

A heat transfer recording sheet comprising a base film, a layer of heat transferable coloring material on one side of the base film and a heat resistant layer on the other side of the base film, wherein said heat resistant layer is formed by curing a mixture comprising a compound of the formula:

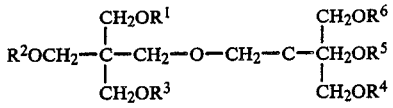

(I)

wherein each of $R^1$, $R^2$, $R^3$, $R^4$ and $R^5$ is an acryloyl group or a methacryloyl group, and $R^6$ is an acryloyl group, a methacryloyl group, an alkyloyl group or a hydrogen atom, and a compound of the formula:

(II)

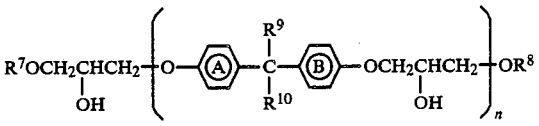

wherein each of $R^7$ and $R^8$ is an acryloyl group or a methacryloyl group, each of $R^9$ and $R^{10}$ is a hydrogen atom, an alkyl group or an aryl group, and each of rings A and B is a benzene ring which may have a lower alkyl group and/or a halogen atom as a substituent, and n is an integer of from 1 to 9, and/or a compound of the formula:

(III)

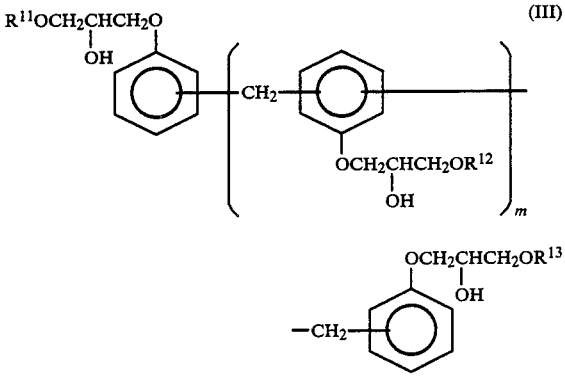

wherein each of $R^{11}$, $R^{12}$ and $R^{13}$ is an acryloyl group or a methacryloyl group, and m is an integer of from 0 to 5.

8 Claims, No Drawings

HEAT TRANSFER RECORDING SHEET

The present invention relates to a heat transfer recording sheet. More particularly, it relates to a heat transfer recording sheet useful for color recording by office equipments such as facsimile machines, printers or copying machines, or for color recording of television images.

For such color recording, various systems are being studied including electrophotography, inkjet and heat sensitive transfer recording. Among them, the heat sensitive transfer recording system is advantageous over other systems in view of the maintanance of the apparatus, easiness in the operation and low costs of the apparatus and supplies.

In the heat sensitive transfer recording system, recording is conducted in such a manner that an image receiving sheet is overlaid on the ink-coated side of a heat transfer recording sheet having a coloring material-containing ink coated thereon, and the rear side of the heat transfer recording sheet is heated by a thermal head to transfer the coloring material in the heat transfer recording sheet to the image receiving sheet. Such a system includes a melt transfer recording system wherein a heat meltable ink is used and a sublimation transfer system wherein an ink containing a sublimable colorant is employed.

However, in the heat sensitive transfer recording system of this type, the heat transfer recording sheet is heated to a high temperature by the thermal head. Therefore, if the heat resistance of the base film of the heat transfer recording sheet is inadequate, the base film tends to fuse and stick to the thermal head. By this fusion and sticking, a sound so-called a stick sound is likely to be generated, or deposition of residue to the thermal head is likely to result. If the fusion proceeds further, proper running of the thermal head will be impossible, whereby recording can no longer be continued. Under the circumstances, it has been proposed to provide a protecting layer of various heat resistant resins in order to improve the heat resistance of the base film (Japanese Unexamined Patent Publications No. 7467/1980 and No. 74195/1982). In order to further improve the running properties, it has been proposed to incorporate heat resistant fine particles, lubricants or surfactants to such a protecting layer (Japanese Unexamined Patent Publications No. 146790/1980, No. 155792/1981 and No. 129789/1982).

However, in a recent trend for high speed recording in such a recording system, it has become common to apply a higher energy than ever to the thermal head, whereby a greater load is imparted to the heat transfer recording sheet, and it has become difficult to ensure adequate running of the thermal head by the methods disclosed in the above-mentioned publications. Particularly in the case of a heat transfer recording sheet for a sublimation transfer recording system wherein a sublimable colorant is used, a high energy is required during recording, as compared with the heat transfer recording sheet for the melt transfer recording system. Thus no adequate running properties of the thermal head will be obtained by a heat transfer recording sheet treated by the conventional methods.

The present inventors studied protecting films of various heat resistant resins for the above-mentioned purpose and as a result have previously found that a protecting film of a resin obtained by curing a compound of the formula:

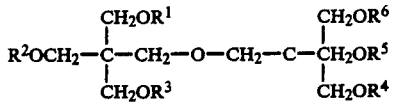

wherein each of $R^1$, $R^2$, $R^3$, $R^4$ and $R^5$ is an acryloyl group or a methacryloyl group, and $R^6$ is an acryloyl group, a methacryloyl group, an alkyloyl group or a hydrogen atom, is particularly effective (Japanese Unexamined Patent Publication No. 212192/1987). However, when a protecting layer of the above resin is formed on a base film, the film undergoes curling due to shrinkage of the cured layer. Therefore, in order to prevent such curling during the preparation of the heat transfer recording sheet, the apparatus is required to have a means of applying a tension to the heat transfer recording sheet. Further, the cartridge for accommodating a roll of the sheet thus produced and the heat transfer recording apparatus will have to have a special structure to prevent such curling. Under the circumstances, a heat transfer recording sheet is desired whereby the running properties of the thermal head are good and no curling takes place, and which thus provides excellent handling and operational efficiency.

The present inventors have conducted extensive researches for a heat transfer recording sheet which provides excellent operational efficiency and excellent running properties for a thermal head and as a result, have now found it possible to obtain a heat transfer recording sheet free from curling and capable of providing excellent running properties for a thermal head even when recording is conducted with a high level of energy, by providing on the base film a heat resistant layer composed of a cured product of a mixture of specific compounds. The present invention has been accomplished on the basis of the discovery.

The present invention provides a heat transfer recording sheet comprising a base film, a layer of heat transferable coloring material on one side of the base film and a heat resistant layer on the other side of the base film, wherein said heat resistant layer is formed by curing a mixture comprising a compound of the formula:

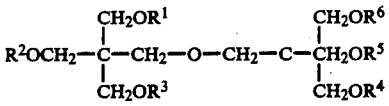

(I)

wherein each of $R^1$, $R^2$, $R^3$, $R^4$ and $R^5$ is an acryloyl group or a methacryloyl group, and $R^6$ is an acryloyl group, a methacryloyl group, an alkyloyl group or a hydrogen atom, and a compound of the formula:

(II)

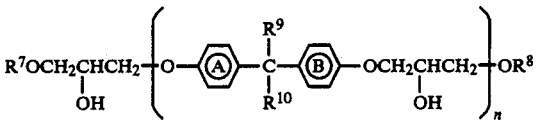

wherein each of $R^7$ and $R^8$ is an acryloyl group or a methacryloyl group, each of $R^9$ and $R^{10}$ is a hydrogen atom, an alkyl group or an aryl group, and each of rings A and B is a benzene ring which may have a lower alkyl group and/or a halogen atom as a substituent, and n is an integer of from 1 to 9, and/or a compound of the formula:

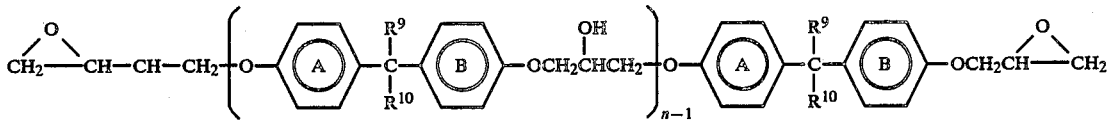

(IV)

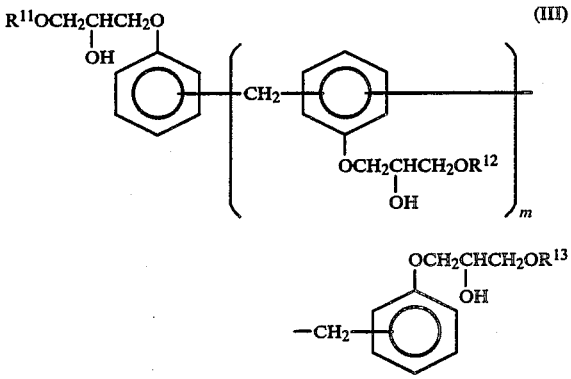

(III)

wherein each of $R^{11}$, $R^{12}$ and $R^{13}$ is an acryloyl group or a methacryloyl group, and m is an integer of from 0 to 5.

Now, the present invention will be described in detail with reference to the preferred embodiments.

The compound of the formula I used for the formation of the heat resistant layer of the present invention, can be obtained by reacting acrylic acid, methacrylic acid or various aliphatic carboxylic acids to dipentaerythritol. These products are slightly yellow transparent liquids or crystals.

In the formula I, $R^6$ may be not only an acryloyl group or a methacryloyl group, but also an alkyloyl group such as an acetyl group, a propionyl group, a n-butyryl group or an i-butyryl group, or a hydrogen atom. However, a compound of the formula I wherein all of $R^1$ to $R^6$ are acryloyl groups and/or methacryloyl groups, is preferred, since such a compound has excellent heat resistance after curing. Such compounds of the formula I may be used alone or in combination as a mixture of a plurality of them.

The compound of the formula II can be obtained, for example, by reacting acrylic acid and/or methacrylic acid to a compound of the formula:

wherein $R^9$, $R^{10}$ and n are as defined above, which is a condensation product of a bisphenol with epichlorohydrin. In the formulas II and IV, specifically, each of $R^9$ and $R^{10}$ is a hydrogen atom; a straight chain or branched chain alkyl group such as a methyl group, an ethyl group, a propyl group, a butyl group, a pentyl group, a hexyl group, a heptyl group or an octyl group; or an aryl group such as a phenyl group, which may be substituted by a methyl group, an ethyl group, a methoxy group, an ethoxy group, a chlorine atom or a bromine atom, and each of rings A and B is a benzene ring which may be substituted by a straight chain or branched chain lower alkyl group such as a methyl group, an ethyl group, a propyl group or a butyl group and/or by a halogen atom such as a fluorine atom, a chlorine atom or a bromine atom, and n is preferably an integer of from 1 to 6.

The compound of the formula III can be obtained, for example, by reacting acrylic acid and/or methacrylic acid to a compound of the formula:

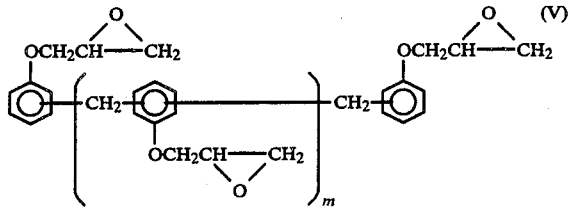

(V)

wherein m is an integer of from 0 to 5 as defined above, which is a condensation product of a novolak resin with epichlorohydrin. In the formulas III and V, m is preferably an integer of from 0 to 3.

Representative examples of the compounds of the formulas II and III may be those having the following structures:

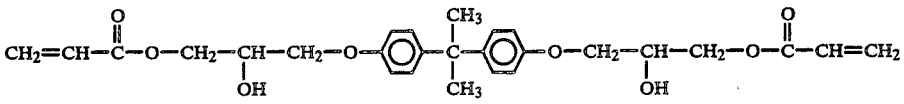

(IIa)

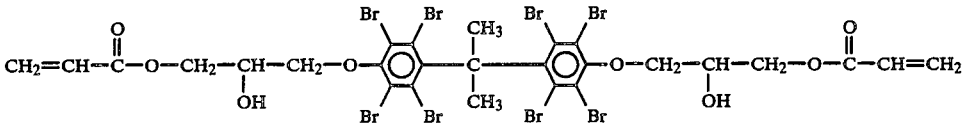

(IIb)

-continued

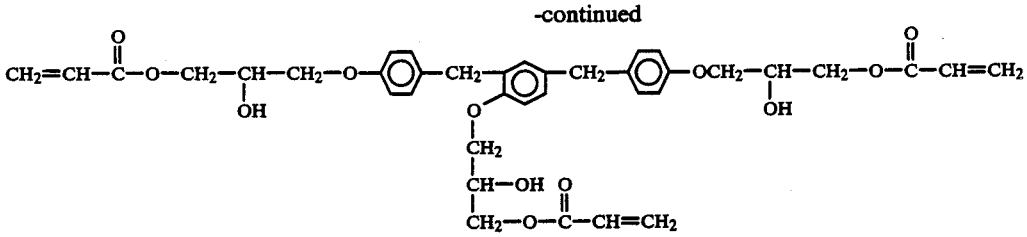

(IIIa)

Such compounds of the formulas II and III may be used alone or in combination as a mixture of a plurality of them.

A conventional method may be used for the formation of a heat resistant layer on a base film for a heat transfer recording sheet by using a mixture of the compounds of the formulas I and II and/or III and by curing the compounds. For example, the heat resistant layer is preferably formed by coating a coating solution containing these compounds on the base film, drying the solution, followed by curing by heating or irradiation with a radiation.

The coating solution may contain, in addition to the compounds of the formulas I and II and/or III, a solvent or a radical polymerization initiator as the case requires. As such a solvent, various solvents may be mentioned including an alcohol, a ketone, an ester, an aromatic hydrocarbon and a halogenated hydrocarbon. The polymerization initiator may be, for example, a benzoin ether such as benzophenone, benzoin, benzoin methyl ether or benzoin ethyl ether; a benzyl ketal such as benzyl methyl ketal or benzyl ethyl ketal; an azo compound such as azobisisobutyronitrile; or an organic peroxide such as benzoyl peroxide, lauryl peroxide, di-t-butyl peroxide, dicumyl peroxide or cumene hydroperoxide. Such a polymerization initiator is used preferably in an amount of from 0.01 to 10% by weight based on the total amounts of the compounds of the formulas I and II and/or III.

When the compound of the formula I is used alone to form a cured layer, it is possible to obtain a cured layer having excellent heat resistance, but heat shrinkage during the curing is substantial, whereby curling of the base film will be substantial. Whereas when a cured layer is formed by using the compound of the formula II or III alone or by using a mixture of the compounds of the formulas II and III only, the heat resistance will be inadequate, and the running properties of the thermal head will be inadequate for recording with a high level of energy. However, when the compound of the formula I and the compound of the formula II and/or the compound of the formula III are used in combination in a proper ratio, it is possible to form a cured layer having excellent heat resistance without curling of the base film. As the mixing ratio, it is preferred that the weight ratio of the total amount of the compounds of the formulas II and III to the compound of the formula I is within a range of from 0.1 to 3.

In order to improve the lubricating properties of the heat resistant layer formed by the cured film for the thermal head and to further improve the running properties of the heat transfer recording sheet, heat resistant organic or inorganic fine particles, various lubricants, surfactants or other additives may be incorporated to the cured film layer.

By roughening the surface of the cured film layer by the addition of heat resistant fine particles, it is possible to reduce the frictional coefficient between the heat resistant recording sheet and the thermal head. Such fine particles may be fine particles of e.g. a metal, a metal oxide, a metal sulfide, carbon black, a mineral, an inorganic salt, ar inorganic pigment, an organic pigment or an organic polymer. More specifically, fine particles cf alumina, silica, titanium oxide, zinc oxide, magnesium oxide, calcium carbonate, graphite, molybdenum sulfide, a silicone resin, a fluorinated resin, a benzoguanamine resin, a phenol resin, a melamine resin or a urea resin. Such particles may have a particle size of from 0.01 to 10 μm. They may be incorporated in an amount of from 5 to 100% by weight based on the total amount of the compounds of the formulas I and II and/or III.

By the addition of a lubricant or a surfactant, it is possible to reduce the frictional coefficient between the heat transfer recording sheet and the thermal head and thereby to prevent or eliminate the generation of static electricity. As such a lubricant or surfactant, those commonly employed may be used. The lubricant and the surfactant are hardly distinguishable, and some of them may commonly be used. However, specific examples of the lubricant include aliphatic hydrocarbons such as liquid paraffin, microcrystalline wax, natural and synthetic wax, polyolefin wax and partial oxides thereof or fluorides and chlorides thereof; fatty acids such as stearic acid, hydroxy stearic acid, capric acid, lauric acid and palmitic acid; aliphatic acid amides such as caproic acid amide, caprylic acid amide, capric acid amide, palmitic acid amide, oleic acid amide, erucinic acid amide and ethylenebisstearic acid amide; higher fatty acid metal salts such as calcium stearate, aluminum stearate and calcium laurate, which are usually called metal soaps; higher alcohols such as stearyl alcohol, cetyl alcohol and capryl alcohol; polyhydric alcohols such as glycerol, polyglycol, polyglycerol pentaerythritol, ethylene glycol and sorbitol; fatty acid esters such as stearic acid monoglyceride, oleic acid monoglyceride, lauric acid sorbitane ester, stearyl stearate, pantaerythritol tetrastearate and butyl stearate; silicone oils such as dimethylpolysiloxane; silicones such as various modified silicone oils; phosphoric acid esters such as alkyl phosphates and phosphoric acid esters of polyoxyalkylene glycols; and others including fluorinated resin particles, graphite and molybdenum disulfide.

The surfactant includes, for example, various anion surfactants such as carboxylates, sulfonates, sulfuric acid esters and phosphoric acid esters; various cationic surfactants such as amine salts and quaternary ammonium salts; various nonionic surfactants including ether type such as polyoxyalkylene alkyl ethers and polyoxyalkylene alkylphenyl ethers, ether ester type such as polyoxyethylene glycerol fatty acid esters, polyoxyethylene sorbitol fatty acid esters and polyethylene glycol fatty acid esters, ester type such as fatty acid monoglyceride, sorbitol fatty acid esters, propylene glycol fatty acid esters and sucrose fatty acid esters, and nitrogen-containing type such as fatty acid amides, polyoxyethylene fatty acid amides and polyoxyethylene alkylamines; various amphoteric surfactants such as various betaine type surfactants and aminocarboxylate type surfactants; fluorine-type surfactants containing fluorine atoms or silicon atoms; and silicone type surfactants.

The above lubricants and surfactants may be effective when used alone, but they may be used in combination, or a lubricant and a surfactant may be used in combination. Further, they may be used in combination with the above-mentioned heat resistant fine particles to further improve the effects. The lubricant and the surfactant may be used in an amount of from 0.1 to 50% by weight based on the total amount of the compounds of the formulas I and II and/or III.

With respect to the manner of coating the above coating solution to form the heat resistant layer, various methods employing e.g. gravure coater, reverse roll coater, wire bar coater or air doctor, as disclosed e.g. in "Coating Systems" edited by Yuji Harasaki (1979) published by Maki Shoten, may be employed.

The coating layer of the above coating solution may be dried by a suitable means to remove the solvent and then cured by a usual method such as heating or irradiation with a radiation. The radiation includes, for example, ultraviolet rays, electron beams and $\gamma$-rays. As specific conditions for curing, the heat curing may preferably be conducted at a temperature of from 50° to 150° C. for from 30 seconds to 10 minutes, and the ultraviolet curing may preferably be conducted by irradiation for from 5 seconds to one minute by an ultraviolet lamp of 80 W/cm from a distance of about 10 cm. Particularly preferred is the curing by means of ultraviolet rays or electron beams.

The thickness of the heat resistant layer formed on the base film is usually from 0.1 to 10 $\mu$m, preferably from 0.5 to 5 $\mu$m.

The base film in the heat transfer sheet of the present invention includes a polyethylene terephthalate film, a polyamide film, a polyaramide film, a polyimide film, a polycarbonate film, a polyphenylene sulfide film, cellophane, a triacetate film and a polypropylene film. Among them, a polyethylene terephthalate film is preferred in view of the mechanical strength, dimensional stability, heat resistance and costs. A biaxially stretched polyethylene terephthalate film is further preferred. The thickness of such a base film is preferably from 1 to 30 $\mu$m, more preferably from 2 to 15

The coloring material layer of the heat transfer recording sheet of the present invention may be formed by a usual method. For example, in the case of a sublimation type heat transfer recording sheet, a sublimable colorant and a heat resistant binder resin are dissolved or dispersed in a proper solvent to obtain an ink, and this ink is coated on the base film, followed by drying. In the case of a melt type heat transfer recording sheet, a colorant such as a pigment or a dye is dissolved or dispersed in a heat meltable substance if necessary by means of a solvent to prepare an ink, and this ink is coated on the base film, followed by drying.

As the sublimable colorant useful for the sublimation heat transfer recording sheet, a nonionic azo type, anthraquinone type, azomethine type, methine type, indoaniline type, naphthoquinone type, quinophthalone type or nitro type colorant may be mentioned. As the binder resin, a polycarbonate resin, a polysulfone resin, a polyvinyl butyral resin, a polyarylate resin, a polyamide resin, a polyaramide resin, a polyimide resin, a polyether imide resin, a polyester resin, an acrylonitrile-styrene resin and a cellulose resin such as acetyl cellulose, methyl cellulose or ethyl cellulose, may be mentioned. As the solvent, an aromatic solvent such as toluene or xylene; a ketone solvent such as methyl ethyl ketone, methyl isobutyl ketone or cyclohexanone; an ester solvent such as ethyl acetate or butyl acetate; an alcohol solvent such as isopropanol, butanol or methyl cellosolve; a halogenated solvent such as methylene chloride, trichloroethylene or chlorobenzene; an ether solvent such as dioxane or tetrahydrofuran; or an amide solvent such as dimethylformamide or N-methylpyrrolidone, may be employed. The thickness of the coating may be from 0.1 to 5 $\mu$m as the thickness of the dried layer.

Further, in the preparation of the recording sheet of the present invention, in order to improve the adhesion between the base film and the respective layers formed by the coating, corona treatment may be applied to the surface of the base film, or a primer coating treatment may be applied with a resin such as a polyester resin, a cellulose resin, a polyvinyl alcohol, a urethane resin or a polyvinylidene chloride.

With the heat transfer recording sheet of the present invention, the thermal head does not stick to the base film even during the high energy recording, and the sheet is suitable particularly for the sublimation heat transfer. Further, it is free from a stick sound due to the sticking or deposition of residue to the thermal head, and the thermal head runs smoothly, whereby a transfer recording of good image quality can be obtained. Further, the recording sheet of the present invention is free from curling and easy to handle. Thus, the present invention is very useful from the industrial point of view.

Now, the present invention will be described in further detail with reference to Examples. However, it should be understood that the present invention is by no means resricted by such specific Examples. In the Examples, "parts" means "parts by weight".

EXAMPLE 1

(a) Preparation of a Heat Transfer Recording Sheet

By using a biaxially stretched polyethylene terephthalate film (thickness 4 $\mu$m) as the base film, a coating solution having the following composition was coated on one side thereof, dried and then treated by a high pressure mercury lamp with an energy of 80 W/cm for an irradiation time of 20 seconds with a distance between the mercury lamp and the film being 115 mm for curing to form a heat resistant layer having a thickness of about 2 $\mu$m.

Composition of the Coating Solution

| | |
|---|---|
| (1) Ultraviolet curable resin: KAYARAD DPHA (tradename, manufactured by Nihon Kayaku K.K.) | 7.5 parts |
| (2) Ultraviolet curable resin: Ripoxy SP-1509 (tradename, manufactured by Showa Kobunshi K.K.) | 7.5 parts |
| (3) Ethyl acetate | 60 parts |
| (4) Isopropyl alcohol | 20 parts |
| (5) Silica fine particles: Aerosil R972 (tradename, manufactured by Nihon Aerosil K.K.) | 3 parts |
| (6) Photo polymerization initiator: Darocure 1173 (tradename, manufactured by Merck Co. | 1 part |
| (7) Silicone surfactant: NUC silicone L7602 (tradename, manufactured | 1 part |

-continued by Nippon Yunica K.K.)

On the opposite side of the heat resistant layer of the above film, an ink comprising 5 parts of a sublimable colorant (C.I. Solvent Blue 95), 10 parts of a polysulfone resin and 85 parts of chlorobenzene, was coated and dried to form a coloring material layer having a thickness of about 1 μm, to obtain a heat transfer recording sheet.

In the above coating solution, KAYARAD DPHA is a mixture of a compound of the formula I wherein $R^1$ to $R^5$ are acryloyl groups and $R^6$ is a hydrogen atom and a compound of the formula I wherein $R^1$ to $R^6$ are acryloyl groups, and Ripoxy SP-1509 is a compound of the formula IIa as given above.

The above heat transfer recording sheet was free from curling even after the formation of the heat resistant layer or after the formation of the coloring material layer, and it was easy to handle.

(b) Preparation of an Image Receiving Sheet

A solution comprising 10 parts of a saturated polyester resin (TP-220, tradename, manufactured by Nihon Gosei K.K.) 0.5 part of an amino-modified silicone (KF-393, tradename, manufactured by Shin-etsu Co., Ltd.), 15 parts of methyl ethyl ketone and 15 parts of xylene, was coated on a synthetic paper (Yupo FPG 150, tradename, manufactured by Oji Yuka K.K.) by a wire bar, then dried (dried layer thickness: about 5 μm) and further heat-treated at 100° C. for 30 minutes in an oven to obtain an image receiving sheet.

(c) Results of Transfer Recording

The recording sheet and the image receiving sheet thus prepared were overlaid one on the other so that the coloring material layer of the recording sheet was in contact with the resin coated side of the image recording sheet, and 50 cm transfer recording was conducted with a density of 8 lines/mm by applying a power of 0.4 W/dot for 10 msec by a thermal head having a heat generating resister density of 8 dot/mm on the heat resistant layer side of the recording sheet. As a result, the sheet run smoothly without sticking between the head and the sheet and without a sticking sound, and excellent transfer recording was obtained. Further, after the recording, the surface of the head was inspected, whereby no deposition of residue was observed.

EXAMPLES 2 to 9

Various heat transfer recording sheets were prepared in the same manner as in Example 1 except that heat resistant layers having thicknesses a shown in Table 1 were formed by using various coating solutions as identified in Table 1, as coating solutions for the formation of heat resistant layers.

Transfer recording was conducted in the same manner as in Example 1 by using each transfer recording sheet thus obtained and an image receiving sheet prepared in the same manner as in Example 1. As the result, in each case, the sheet run smoothly without sticking between the head and the sheet and without a stick sound, and excellent transfer recording was obtained. Further, after the recording, the surface of the head was inspected, and no deposition of residue was observed. Each sheet was free from curling and easy to handle.

TABLE 1

| Example | Coating solution for forming a heat resistant layer | Thickness of the heat resistant layer (μm) |
|---|---|---|
| 2 | Same as in Example 1 | 1 |
| 3 | Same as in Example 1 except that Ripoxy SP-4010*1 was used instead of ultraviolet curable resin Ripoxy SP-1509 | 2 |
| 4 | Same as Example 3 | 1 |
| 5 | Same as Example 1 except that KAYARAD D-310*2 was used instead of ultraviolet curable resin KAYARAD DPHA | 2 |
| 6 | Same as Example 3 except that silicone resin particle Tospearl 120*3 was used instead of silica fine particles Aerosil R972 in Example 3 | 2 |
| 7 | Same as Example 1 except that the amounts of ultraviolet curable resins KAYARAD DPHA and Ripoxy SP-1509 in Example 1 were changed from 7.5 parts and 7.5 parts to 13.5 parts and 1.5 parts, respectively. | 2 |
| 8 | Same as in Example 1 except that the amounts of ultraviolet curable resins KAYARAD DPHA and Ripoxy SP-1509 in Example 1 were changed from 7.5 parts and 7.5 parts to 4 parts and 11 parts, respectively. | 2 |
| 9 | Same as Example 1 except that 10 parts of KAYARAD DPHA, 2.5 parts of Ripoxy SP-1509 and 2.5 parts of Ripoxy SP-4010 were used as ultraviolet curable resins. | 2 |

Notes for Table 1

*1Tradename, manufactured by Showa Kobunshi K.K.; reaction product of acrylic acid to a reaction product of novolak resin with epichlorohydrin.

*2Tradename, manufactured by Nippon Kayaku K.K.; a compound of the formula I wherein $R^1$ and $R^5$ are acryloyl groups, and $R^6$ is an alkyloyl group.

*3Tradename, manufactured by Toshiba Silicone K.K.

COMPARATIVE EXAMPLE 1

A heat resistant layer was formed on a film in the same manner as in Example 1 except that in the coating solution for forming the heat resistant layer, 15 parts of KAYARAD DPHA was used alone as the ultraviolet curable resin. After curing, the film curled to form a coil with the heat resistant layer being inside.

COMPARATIVE EXAMPLE 2

A heat transfer recording sheet was prepared in the same manner as in Example 1 except that in the coating solution for forming the heat resistant layer, 15 parts of Ripoxy SP-1509 was used alone as the ultraviolet curable resin. Transfer recording was conducted in the same manner as in Example 1 by using this heat transfer recording sheet. As a result, a stick sound during the recording was substantial (the running properties of the head was poor), and the sheet did not run smoothly.

We claim:

1. A heat transfer recording sheet comprising a base film, a layer of heat transferable coloring material on one side of the base film and a heat resistant layer on the other side of the base film, wherein said heat resistant layer is formed by curing a mixture comprising a compound of the formula:

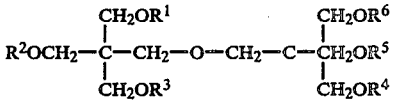

(I)

wherein each of $R^1$, $R^2$, $R^3$, $R^4$ and $R^5$ is an acryloyl group or a methacryloyl group, and $R^6$ is an acryloyl group, a methacryloyl group, an alkyloyl group or a hydrogen atom, and a compound of the formula:

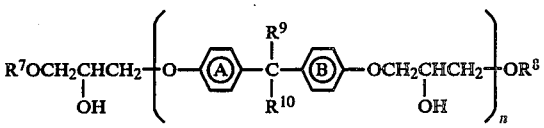

(II)

wherein each of $R^7$ and $R^8$ is an acryloyl group or a methacryloyl group, each of $R^9$ and $R^{10}$ is a hydrogen atom, an alkyl group or an aryl group, and each of rings A and B is a benzene ring which may have a lower alkyl group and/or a halogen atom as a substituent, and n is an integer of from 1 to 9,and together with or as a replacement for the compound of the formula of (II) a compound of the formula:

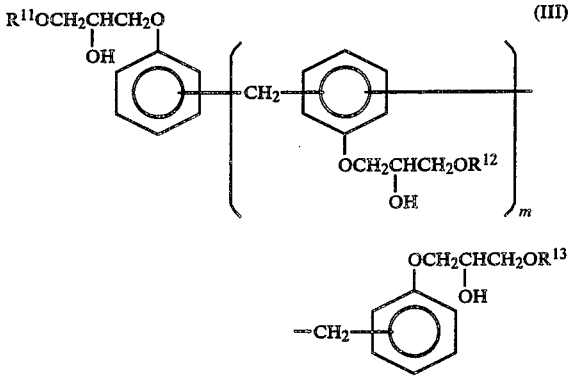

(III)

wherein each of $R^{11}$, $R^{12}$ and $R^{13}$ *is an acryloyl group or a methacryloyl group, and m is an integer of from* 0 to 5.

2. The heat transfer recording sheet according to claim 1, wherein the weight ratio in the mixture of the total amount of the compounds of the formulas II and III to the compound of the formula I is within a range of from 0.1 to 3.

3. The heat transfer recording sheet according to claim 1, wherein the heat resistant layer has a thickness of from 0.1 to 10 μm.

4. The heat transfer recording sheet according to claim 1, wherein the base film is a polyethylene terephthalate film having a thickness of from 1 to 30 μm.

5. The heat transfer recording sheet according to claim 1, wherein the layer of heat transferable coloring material has a thickness of from 0.1 to 5 μm.

6. The heat transfer recording sheet according to claim 1, wherein the heat resistant layer contains heat resistant fine particles.

7. The heat transfer recording sheet according to claim 1, wherein the heat resistant layer contains a lubricant.

8. The heat transfer recording sheet according to claim 1, wherein the heat resistant layer contains a surfactant.

* * * * *